United States Patent [19]

Kawabata

[11] 4,326,506

[45] Apr. 27, 1982

[54] VIBRATILE MAT

[76] Inventor: Ichiro Kawabata, 282 Oaza Yono, Yono-shi, Saitama-ken, Japan

[21] Appl. No.: 169,101

[22] Filed: Jul. 15, 1980

[30] Foreign Application Priority Data

Jul. 16, 1979 [JP] Japan ..... 54-97730[U]
Dec. 3, 1979 [JP] Japan ..... 54-167401[U]

[51] Int. Cl.[3] ..... A61H 1/00

[52] U.S. Cl. ..... 128/33; 128/1.5; 128/41

[58] Field of Search ..... 128/32, 33, 36, 24.1, 128/24.2, 24 R, 1.3, 1.5, 41

[56] References Cited

U.S. PATENT DOCUMENTS

| | | | |
|---|---|---|---|
| Re. 24,487 | 6/1958 | Leach | 128/33 |
| 2,943,620 | 7/1960 | Sibert | 128/24.1 |
| 3,044,462 | 7/1962 | Lefvenius | 128/33 |
| 3,113,567 | 12/1963 | Russell | 128/33 |
| 3,322,117 | 5/1967 | McCarr | 128/33 |
| 3,613,673 | 10/1971 | La Hue | 128/33 |
| 3,727,607 | 4/1973 | Dill | 128/33 |
| 4,030,487 | 6/1977 | McEachran | 128/33 |
| 4,136,685 | 1/1979 | Ramey | 128/33 |
| 4,186,734 | 2/1980 | Stratton | 128/33 |
| 4,257,408 | 3/1981 | Ramey | 129/32 |

FOREIGN PATENT DOCUMENTS

| | | | |
|---|---|---|---|
| 1900744 | 1/1969 | Fed. Rep. of Germany | 128/1.3 |

*Primary Examiner*—Richard C. Pinkham
*Assistant Examiner*—T. Brown
*Attorney, Agent, or Firm*—Steinberg & Raskin

[57] ABSTRACT

A vibratile mat is provided. The vibratile mat comprises a reasonating member, vibrating means and a pad. The resonating member includes a plate-like base and a plurality of convex walls arranged and fixed onto the top face of the plate-like base at a predetermined intervals. Each convex wall has a number of wart-like small projections formed on the top face thereof. The base and convex wall are composed of a hard plastic material. The vibrating means is placed in a cavity formed by hollowing the resonating member. The pad is disposed on the top face of the resonating member. The pad is composed of a material softer than the material of the resonating member.

9 Claims, 8 Drawing Figures

VIBRATILE MAT

BACKGROUND OF THE INVENTION

The present invention generally relates to a mat that is used as a cushion, a bed, a mattress or the like. More particularly, the invention relates to a vibratile mat having a vibrating member disposed therein, in which by vibrations produced by this vibrating member, the stiffness in the muscle can be relieved and circulation of the blood in a user can be improved.

It has been considered that local pressing of points of the human body is effective for restoring or maintaining normal functions of respective portion of the human body, dissipating the fatigue and curing certain kinds of diseases, and it is the finger-pressure therapy of the Oriental medicine that embodies this idea.

According to this finger-pressure therapy, points of the human body are locally pressed intentionally by the finger bulbs. If an effect resembling the pressing effect according to the finger-pressure therapy is automatically obtained without this intentional pressing, for example, while a patient is lying, this will confer great healthful benefits upon the patient and be helpful for maintenance and promotion of health while dissipating the fatigue.

As means for producing this effect resembling the finger-pressing effect, there have heretofore been provided mattresses and cushions having a great number of projections on the surfaces thereof. In these conventional products, however, no intended finger-pressing effect can be obtained unless the projections are considerably hard and the projecting length is sufficiently large. More specifically, these projections butt against points of the body continuously with a constant pressing force under the load of the body weight and therefore, a discontinuous pressing with a varying pressing force, such as attained by the finger-pressure therapy, cannot be generated. For this reason, in order to intensify local pressing, the projections should be hard and the projection length should be increased. However, if the hardness of the projections is increased and the projection length is made larger, since pressing is continued on specific points on the human body selectively, the user soon feels pains on these points. Accordingly, these conventional products cannot be used as mats or cushions for inducing peaceful sleep. From the practical viewpoints, therefore, the projections should be formed of a soft and elastic material or the projection length should be considerably decreased. In this case, no satisfactory pressing effect can be expected.

SUMMARY OF THE INVENTION

It is therefore a primary object of the present invention to provide a vibratile mat which can produce a pressing effect equivalent to the effect attained by the finger-pressure therapy.

Another object of the present invention is to provide a vibratile mat which can be used continuously for a long time without giving any pain to the body of a user.

Still another object of the present invention is to provide a vibratile mat which can impart a vibrating action and/or a magnetic action to the body of a user.

A further object of the present invention is to provide a vibratile mat which is excellent in the air permeability.

Other object and advantages of the present invention will become apparent from the following detailed description made with reference to the accompanying drawings.

The vibratile mat of the present invention comprises a resonating member including a plate-like base of a hard plastic material having an optional thickness and a certain elasticity and convex walls formed of a hard plastic material and having a certain elasticity, which are arranged at appropriate intervals and fixed onto the top face of said base, each of said convex walls having a number of wart-like projections on the top face thereof, a vibrator placed in a cavity formed by hollowing parts of the base and convex walls, and a pad disposed on the top faces of the resonating member and vibrator to cover the resonating member and vibrator, said pad being formed of a material softer than the material of the resonating member.

The vibrator that is used for the vibratile mat according to the present invention comprises an electromagnetic vibrating body and selectively usable two cover members having the same shape and being dismountably mounted on the vibrating body, one of said cover members being formed of a ferromagnetic material and the other cover member being formed of a non-magnetic material.

BRIEF DESCRIPTION OF THE DRAWINGS

For a fuller understanding of the present invention, the reference is had to the following description taken in connection with the accompanying drawings, in which.

DETAILED DESCRIPTION OF THE PREFERRED EMBODIMENTS

Figure 1:
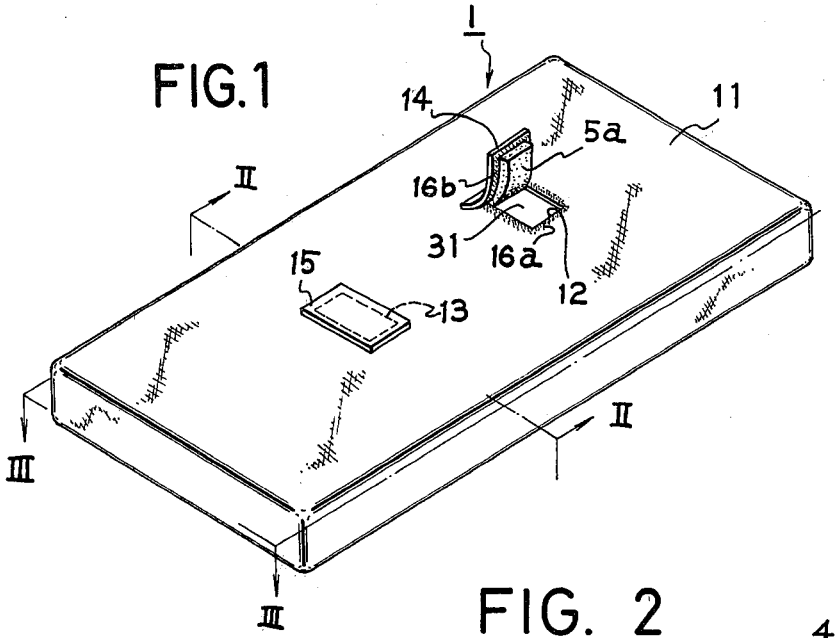
FIG. 1 is a perspective view illustrating one embodiment of the present invention in the state where the vibrator is omitted.

Referring to FIG. 1, there is shown a mattress according to one embodiment of the vibratile mat of the present invention in the state where a vibrator described hereinafter is omitted, in which two openings 12 and 13 are formed on the top face of a mattress 1 covered with a cloth cover 11, and patch cloth pieces 14 and 15 are dismountably attached to the openings 12 and 13, respectively, to shut these openings 12 and 13. Known fasteners such as hooks, snaps and zippers may be used as means for attaching and removing these patch cloth pieces 14 and 15. In the embodiment shown in FIG. 1, known fastening plastic pieces **16*a* and 16*b*, one group 16*a* having a number of loops and the other group 16*b* having a number of hooks to be engaged therewith, are attached and sewn to the peripheral edges of the openings 12 and 13 of the cloth cover 11 and the peripheral edges of the back faces of the patch cloth pieces 14 and 15, respectively. In FIG. 1, reference numeral 5***a* represents a pad piece fixed to the back face of each of the patch cloth pieces 14 and 15, and reference numeral 31 represents a cavity for containing therein a vibrator described hereinafter.

The internal structure of the vibratile mat will now be described with reference to FIG. 2 and FIG. 3.

Figure 4:
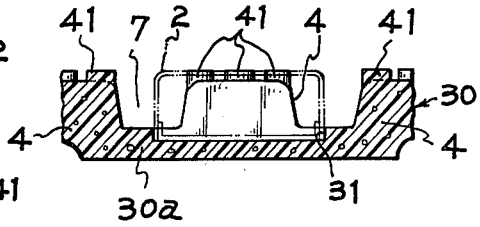
FIG. 4 is a sectional view showing another embodiment of the vibrator-containing cavity shown in FIG. 3.

A resonating member 3 comprises a base 3*a*, convex walls 4 and small projections 41 formed on the top faces of the convex walls 4. The base 3*a* is composed of a plate of a hard plastic material having a certain elasticity, for example, a plate of foamed polyethylene. Convex walls 4 having an optional width are arranged at certain intervals on the top face of the base 3*a* integrally therewith. A number of wart-like small projections 41 are formed at optional intervals on the top face of each convex wall 4. In this embodiment, the convex walls 4 and small projections 41 are formed integrally with the base 3*a*. A modification in which the convex walls 4 and small projections 41 are separately formed and fixed to the base 3*a* to form a structure as described above may be adopted in the present invention. Also in this case, the convex walls 4 and small wart-like projections 41 are formed of a hard plastic material having a certain elasticity, such as a foamed polyethylene. An upper pad 5 is placed on the top face of the resonating member 3 to cover the top face of the resonating member 3 entirely. The pad 5 may be formed of any of cotton, non-woven fabrics, soft plastics and synthetic rubbers, but it is indispensable that the pad 5 should be formed of a material softer than the material of the convex walls 4 and wart-like small projections 41 and the pad 5 should have a thickness such that the presence of the wart-like small projections 41 and the vibration of the vibrator described hereinafter can be sensed outwardly of the cloth cover 11. In this embodiment, the upper pad 5 and pad piece 5*a* are formed of a synthetic rubber, and convexities and concavities 5*b* are formed on the top face of the pad 5 so that the pad 5 has a wavy sectional shape. Of course, the pad 5 may be a plate-like member. A lower pad 6 is placed on the lower face of the resonating member 3 to cover said lower face, and this lower pad 6 is formed of a material similar to the material of the upper pad 5. A modification in which this lower pad 6 is not disposed may be adopted in the present invention. A groove 7 is formed between every two adjacent convex walls 4. A cavity 31 is formed by hollowing parts of the above-mentioned base 3*a* and convex walls 4 of the resonating member 3, and the vibrator 2 described hereinafter is disposed in this cavity 31. This cavity 31 may be a hole piercing through the base 3*a* as shown in FIG. 2. Alternately, this cavity 31 may be a bottomed groove not piercing through the base 30*a* of the resonating member 30 as shown in FIG. 4, so that the vibrator 2 may be placed in this groove.

Preferred embodiments of the vibrator 2 to be placed in the above-mentioned cavity 31 are illustrated in FIGS. 5 to 8.

Figure 5:
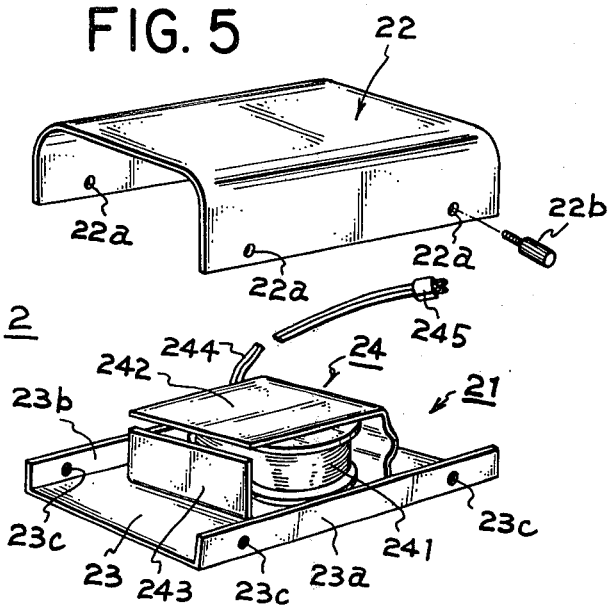
FIG. 5 is a fragmentary perspective view illustrating one embodiment of the vibrator that is used for the vibratile mat of the present invention.

Referring to FIG. 5, the body 21 includes an electromagnetic vibrator 24, fixed to the top face of a metal substrate 23. Rising pieces 23*a* and 23*b* are formed from confronting sides of the substrate 23, and one to two screw holes 23*c* are formed through each of the rising pieces 23*a* and 23*b*. The electromagnetic vibrator 24 includes a magnet portion 241, a vibrating plate 242 and a stationary plate 243. As shown in the drawings, an iron plate is bent so as to surround the magnet portion 241 having a wire wound thereon, and both the ends of the iron plate are made to confront each other with a certain distance therebetween, so that the stationary side of the iron plate acts as the stationary plate 243 and the confronting side of the iron plate acts as the vibrating plate 242.

Figure 7:
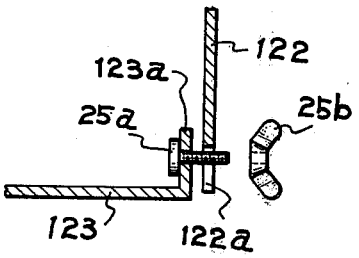
FIG. 7 is a sectional partial view showing another embodiment of means for attaching a vibrator cover.
Figure 8:
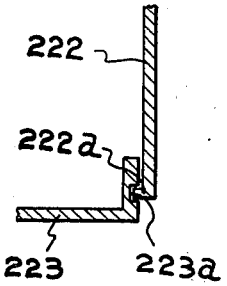
FIG. 8 is a sectional partial view showing still another embodiment of means for attaching a vibrator cover.
Figure 6:
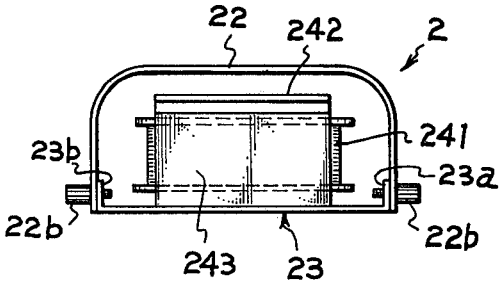
FIG. 6 is a side view showing the assembled state of the vibrator shown in FIG. 5.

A cover 22 has a shape such that it covers the body 21 without falling in contact with the electromagnetic vibrator 24. Piercing holes 22*a* to be fitted with the above-mentioned screw holes 23*c* are formed on the confronting sides of the cover 22. It is preferred that the front and back face portions of the cover 22 be opened so that no sympathetic sounds are caused by vibrations. As shown in FIG. 6, the cover 22 is capped on the body 21, and the cover 22 is fixed to the body 21 by screwing finger-clamping screws 22*b* into the screw holes 23*c* of the body 21 from the outside through the piercing holes 22*a* of the cover 22, whereby the vibrator 2 is constructed. This coupling of the cover 22 to the substrate 23 of the body 21 can be accomplished very easily by the hands assuredly. A structure shown in FIG. 7 may be adopted instead of the structure illustrated above with reference to FIG. 5. Referring to FIG. 7, a male screw 25*a* is screwed and fixed to a rising piece 123*a* of the substrate 123 so that the male screw 25*a* projects outward, and a screw-receiving notch hole 122*a* is formed on the cover 122 at the part corresponding to the above-mentioned piercing hole 22*a*. The male screw 25*a* is fitted in this notch hole 122*a*, and a screw nut 25*b* is screwed and clamped to the male screw 25*a* from the outside of the cover 122. Furthermore, there may be adopted an embodiment in which, as shown in FIG. 8, a convex portion 222*a* formed on the lower end portion of the cover 222 is pressed and fitted into a concave groove 223*a* of the substrate 223.

It is preferred that two or three covers, especially three covers, that have the same structure but are composed of different materials, for example, a ferromagnetic hard material and a non-magnetic hard material, be reserved so that they can be exchanged with one another and combined selectively with the body 21. A material that is readily magnetized and hardly absorbs vibrations, for example, an iron plate, is preferred as the cover 22 formed of a ferromagnetic material. The non-magnetic hard material is roughly divided into a certain metal material and a non-metallic material. The former material is not magnetized and hardly absorbs vibrations, and a stainless steel plate is most preferred. The latter material is not magnetized but absorbs vibrations, and for example, a hard synthetic resin plate and a hard rubber plate are preferably used.

Figure 2:
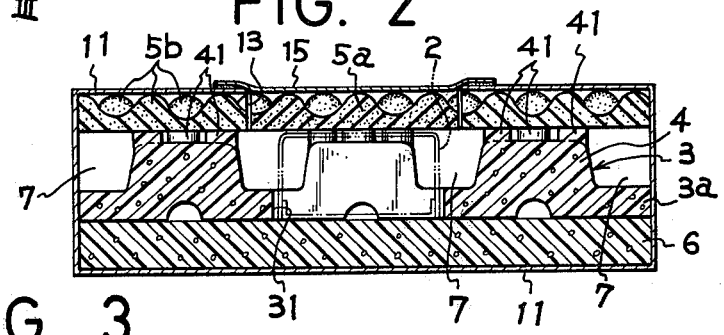
FIG. 2 is a view showing the section taken along the line II—II in FIG. 1.
Figure 3:
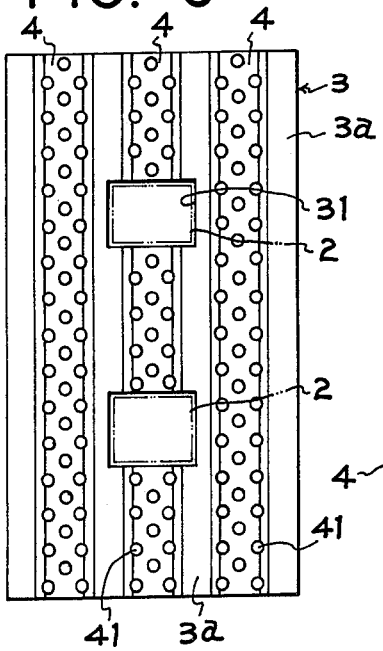
FIG. 3 is a view showing the section taken along the line III—III in FIG. 1.

A power source cord 244 and a plug 245 of the vibrator 2 shown in FIG. 5 are guided to the outside from guide holes (not shown) formed on the cloth cover 11 through the above-mentioned grooves 7 (See FIG. 2).

The vibrator 2 having the above-mentioned structure is inserted into the cavity 31 from the opening 12 and 13 formed on the top face of the mattress so that the vibrator 2 sinks slightly from the top face of the mattress. In the embodiment of the mattress shown in FIG. 1, the vibrators 2 are arranged at the positions corresponding to the shoulders and waist of a user lying on the mattress. The cavity 31 which has the vibrator 2 contained therein is openably shut by the patch piece 14 and 15. It is preferred that the patch pieces 14 and 15 be formed of the same material as of the cloth cover 11 and pad pieces 5*a* be fixed to the back faces of the patch pieces 14 and 15 so that they are embedded in spaces above the cavities 31, as is seen from FIG. 1.

In the mat of the present invention having the above-mentioned structure, if a household electric current, that is, an alternating current, is supplied to the magnet portion 241 of the body 21 of the vibrator 2, a magnetic field is produced to cause the vibrating plate 242 to perform vibrating movements continuously.

If the cover 22 of the iron plate is selected among the above-mentioned three kinds of the covers 22 and attached to the body 21, the produced magnetic field is absorbed but the vibrations are transmitted to the cover 22 of the iron plate and then transmitted strongly to the body of the user through the pad piece 5*a* just above the cover 22. Therefore, a sufficient vibrating effect alone can be obtained.

If the cover 22 of the stainless steel which is non-magnetic is attached to the body 21, the magnetic field is produced through both the cover 22 and the pad piece 5*a*, and the vibrations are directly transmitted to the stainless steel plate cover 22. Accordingly, the vibrations are strongly transmitted to the body of the user through the pad piece 5*a* just above the cover 22. In this case, both the magnetic effect and the vibrating effect can be simultaneously attained sufficiently.

If the cover 22 of the synthetic resin plate is attached to the body 21, the magnetic field is not influenced and is produced through the cover 22. On the other hand, the vibrations are considerably absorbed in the synthetic resin because of elastic characteristics thereof and they are drastically weakened. Accordingly, in this case, only the magnetic effect is given to the body of the user.

As will be apparent from the foregoing illustrations, in the mat according to the present invention, when each patch piece 14, 15 is opened and each vibrator 2 is taken out from the cavity 31, the cover 22 of the vibrator 2 can be exchanged with other cover 22. Therefore, an appropriate cover 22 can be selected according to the blood pressure or heart condition of the user, the presence or absence of internal or external diseases and the body condition so as to obtain the magnetic effect or vibrating effect selectively or obtain both the effects simultaneously. Accordingly, a satisfactory fatigue-relieving effect can be attained appropriately without any damage being given to the body. Furthermore, in the magnetism produced by an alternating current magnet, the magnetic field is discontinued at predetermined cycles, and in this point, the magnetism produced by the alternating current magnet is different from the magnetism produced by a permanent magnet in which the magnetic field is constant and continuous. Accordingly, the magnetism produced in the vibratile mat of the present invention has preferred influences on circulation of the blood.

Since both the base 3*a* and convex walls 4 of the resonating member 3 containing the vibrator 2 therein are formed of a foamed plastic material which is hard and has a certain elasticity, vibrations of the vibrator 2 are effectively transmitted to the resonating member 3 located in the vicinity of the vibrator 2 and the wart-like projections 41 of the convex walls 4 are caused to press the body of the user while vibrating strongly and uniformly. By the synergistic effect of the pressing and vibrating actions of the wart-like projections 41, which is quite different from the mere vibrating effect of the vibrator 2, there can be attained an excellent effect comparable to the effect attained by the finger-pressure therapy. Furthermore, since the wart-like projections 41 are pressed to the body of the user through the pad 5, the user does not feel any pain even if the pressing action is applied to the body continuously for a long time, and a good effect can be maintained without any reduction. Still further, in the vibratile mat of the present invention, since a sufficient empty space is present in the resonating member 3, a good air premeability is guaranteed.

What is claimed is:

1. A vibratile mat comprising:

a resonating member including a plate-like base and a plurality of convex walls arranged and fixed onto the top face of said plate-like base at a predetermined intervals, each convex wall having a number of wart-like small projections formed on the top face thereof, said plate-like base and convex wall being composed of a hard plastic material;

vibrating means placed in a cavity formed by hollowing said resonating member; and a pad disposed on the top face of said resonating member to cover said resonating member, said pad being composed of a material softer than the material of said resonating member.

2. A vibratile mat as set forth in claim 1, wherein said resonating member is composed of foamed polyethylene, and said plate-like base and convex walls being formed integrally with each other.

3. A vibratile mat as set forth in claim 1, wherein said vibrating means comprises a vibrating plate and an electromagnetic magnet for exciting said vibrating plate.

4. A vibratile mat as set forth in claim 3, wherein said vibrating means is provided with a cover for covering said electromagnetic magnet and vibrating plate.

5. A vibratile mat as set forth in claim 4, wherein said cover is composed of a ferromagnetic metal.

6. A vibratile mat as set forth in claim 4, wherein said cover is composed of a non-magnetic metal.

7. A vibratile mat as set forth in claim 4, wherein said cover is composed of a hard plastic material.

8. A vibratile mat as set forth in claim 4, wherein said vibrating means is dismountably attached to said resonating member.

9. A vibratile mat comprising:

a resonating member composed of a hard plastic material and including a base, a plurality of convex walls fixedly disposed on the top face of said base at a predetermined intervals and a number of wart-like small projections formed on the top face of each said convex wall, said resonating member having a plurality of cavities therein;

vibrating means placed in said cavities;

a pad disposed on the top face of said resonating member for covering said resonating member, said pad being composed of a material softer than the material of said resonating member; and an outer cover for enclosing said resonating member, vibrating means and said pad.

* * * * *